United States Patent [19]

Matsumoto et al.

[11] 4,019,822

[45] Apr. 26, 1977

[54] PENCILS NOT REQUIRING SHARPENING

[75] Inventors: Takeshi Matsumoto; Hidehiko Kaji, both of Sodegaura; Osamu Isogai, Ichihara; Masami Tomikawa, Sodegaura, all of Japan

[73] Assignee: Idemitsu, Kosan Kabushiki-Kaisha (Idemitsu Kosan Co., Ltd.), Tokyo, Japan

[22] Filed: Sept. 2, 1975

[21] Appl. No.: 609,517

[30] Foreign Application Priority Data

Sept. 6, 1974 Japan ..... 49-107698

[52] U.S. Cl. ..... 401/96

[51] Int. Cl.[2] ..... B43K 19/14

[58] Field of Search ..... 401/96, 97

[56] References Cited

UNITED STATES PATENTS

| | | | |
|---|---|---|---|
| 2,720,966 | 10/1955 | Davis | 401/97 X |
| 2,770,358 | 11/1956 | Keith | 401/97 X |
| 3,010,862 | 11/1961 | Basche | 401/97 X |
| 3,704,071 | 11/1972 | Muller et al. | 401/96 |

*Primary Examiner*—Lawrence Charles
*Attorney, Agent, or Firm*—Flynn & Frishauf

[57] ABSTRACT

Pencils not requiring sharpening are produced by wrapping a thermoplastic resin sheet, which has been uniaxially stretched, around a core material so that a stretched direction of the sheet forms a spiral against the core material, whereby the sheet forms a holder for the pencil which may be stripped off to selectively expose the core material.

8 Claims, 16 Drawing Figures

PENCILS NOT REQUIRING SHARPENING

BACKGROUND OF THE INVENTION a. Field of the invention

The present invention relates to pencils not requiring sharpening, and more particularly to such pencils which comprise a core material and a thermoplastic resin sheet which has been uniaxially stretched. The resin sheet is wrapped around the core material so that a stretched direction of the sheet forms a spiral against the core material, whereby the sheet is formed as a holder for the pencil.

b. Description of the prior art

Conventional pencils not requiring sharpening are fabricated by wrapping paper around a lead material (i.e., a mixture of graphite and clay). In these conventional pencils, the paper is perforated for stripping off and the lead material can be exposed by a length corresponding to a distance between adjacent perforations by stripping off paper along a perforation.

Such conventional pencils have a defect of poor waterproofness because the holder material is paper, and in addition, there is a problem that a length of the exposed lead material is limited to a width between adjacent perforations of the paper holder material. The width of paper between perforations cannot be made as narrow as desired when the strength of paper, treating, ease of manufacture, etc. are taken into account. Further it takes much labor to make such narrow or closely spaced perforations. Furthermore, in the case of the conventional products, surface covering treatment was indispensable to hide the perforations after wrapping around the lead material so as to improve the appearance of the outer surface. This surface covering makes stripping off of the surface difficult and it becomes necessary to insert a thread under the surface covering.

SUMMARY OF THE INVENTION

In accordance with the present invention, there are provided pencils not requiring sharpening comprising a core material and an uniaxially stretched thermoplastic resin sheet material.

The thermoplastic resin sheet which is used in the present invention is a thermoplastic resin sheet produced by uniaxial stretching and thereby given a property of being capable of being torn off in narrow strips along the stretched direction. The sheet is wrapped around the core material and itself forms a holder for the resultant pencil.

The exposure of core material is done at users' discretion by utilizing the capability of the resin sheet forming the holder of being easily torn off in narrow strips without requiring perforations to be made in the sheet material.

In the Figures, the reference designations *a* and *b* indicate the sheet material and the reference designation *c* indicates the core material.

DESCRIPTION OF THE PREFERRED EMBODIMENTS

A pencil according to the present invention, which does not require sharpening, comprises a core material *c* and a thermoplastic resin sheet *a* of uniaxial stretching. The resin sheet *a* is wrapped around the core material *c* so that a stretched direction of the sheet forms a spiral against the core material and the sheet is formed a holder.

As to the core material *c*, lead material (i.e., a mixture of graphite and clay), crayon, stick-shaped shoeshine, lipstick, eraser and the like substances can be used.

As resin materials for the present invention, thermoplastic resins capable of being stretched can be used. For instance, a polyolefin resin such as a high pressure polyethylene, an intermediate pressure polyethylene, a low pressure polyethylene, a polypropylene and their variations is preferred; however, a vinyl resin such as polystyrene and polyvinyl chloride can also be used. These resins may be used alone, and also, it is possible to use mixtures thereof or to add an inorganic filler to them. As inorganic fillers, metal oxides such as zinc oxides, titanium oxide, etc. as well as metal salts such as magnesium carbonate, barium sulfate, calcium sulfate, calcium carbonate, calcium sulfite, etc., silicates such as silicic acid, kaoline, talc, etc., and aluminium compounds such as alumina, alumina hydrate, etc., can be used. They can be used alone or in the form of mixtures. It is usually preferred that they be in the form of a powder of less than 10 $\mu$ particle size. These fillers are added in a ratio of 40–400 parts by weight per 100 parts by weight of resin.

Figure 1:
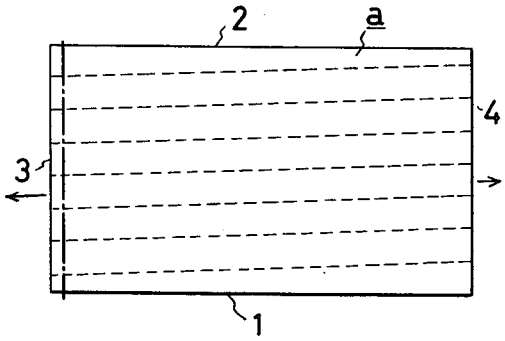
FIGS. 1 and 2 illustrate the sheet material used to make a holder for a pencil in accordance with the present invention.
Figure 2:
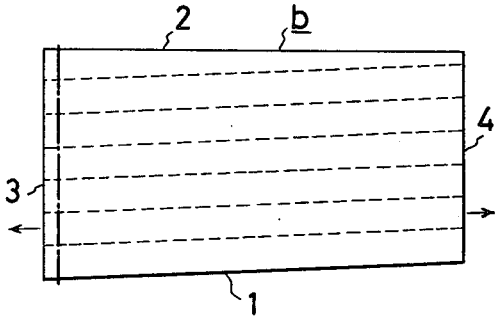

FIGS. 1 and 2 illustrate examples of the form of a sheet material which is used as a holder for a pencil according to the present invention. Dashed lines in FIGS. 1 and 2 show the direction of stretching (i.e., direction of tearing off), and chain lines show the direction of placing a core material when wrapping the sheet around it. Reference numeral 1 designates an end constituting a top point exposing the core material after wrapping, reference numeral 2 its opposite end, reference numeral 3 an end that is to be rolled inside, and reference numeral 4 an end exposed to the surface when wrapped.

A sheet *a,b* of uniaxial stretching is obtained by the following process; the aforesaid resin or mixture of resin and filler is heated to fusion and then is formed as a sheet with an appropriate sheet-molding machine. In such case, a molding assistant, coloring agent, antistatic agent, etc. can be further added as desired.

The resulting resin sheet is then stretched in an uniaxial direction with a stretching machine. By this stretching process, resin molecules are oriented in the direction of stretching, as indicated by the dashed lines in FIGS. 1 and 2, and the stretched sheet is given the properly of being capable of being torn off along the stretched direction. The dashed lines in FIGS. 1 and 2 indicate lines generally along which the sheet is capable of being torn.

The present invention further comprises a process of cutting such stretched sheet into the required form and of wrapping it around the specified core material such that the direction of stretching forms a spiral along the core material.

Sheet material *a* in FIG. 1 is generally rectangular and the stretched direction is at a small angle to the end 1 and rises toward the right, as illustrated in FIG. 1. The angle of the stretched direction relative to the end 1 varies depending upon the thickness of the sheet *a* and the diameter of a core material *c* used in the resultant product; however, it is 2° – 4° in the case of usual pencils. Sheet material *b* in FIG. 2 is an example in which the end 1 is cut in parallel with the stretched direction in advance. In the present invention, the core material *c* is placed along the end 3 as shown in FIGS. 1 and 2 to form a center, and the sheet is wrapped around the core.

Figure 3:
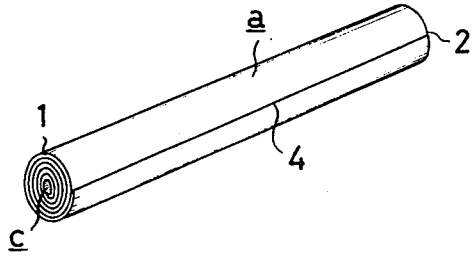
FIGS. 3 and 4 are representative views of pencils fabricated using the sheet of FIGS. 1 and 2.
Figure 4:
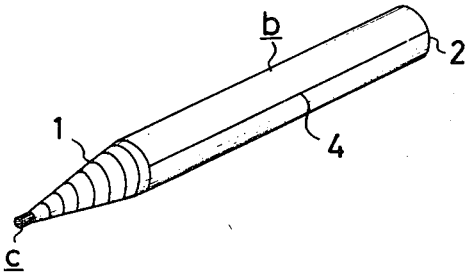
Figure 5:
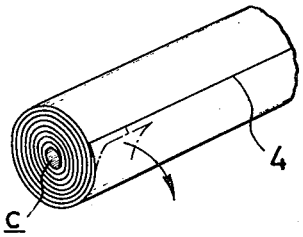
FIGS. 5 and 6 are enlarged perspective views of portions of the pencil of the present invention for explaining how to strip off the sheet material in order to expose the core material.
Figure 6:
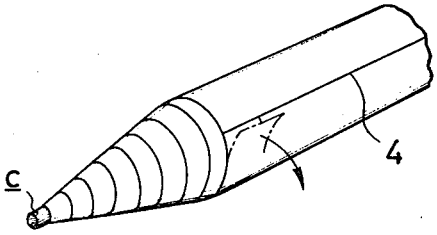

FIGS. 3 and 4 are perspective views of pencils obtained by wrapping the sheet material *a* in FIG. 1 and sheet material *b* in FIG. 2, respectively, around the core material *c*. The sheet material is fixed in place by applying an adhesive to the whole surface of the sheet or to end 4 of the sheet. In the present invention, to expose the core material *c*, the sheet material *a,b* is stripped off from the end 4 of the sheet material exposed to the outer surface of the wrapped sheet by the approximate width measured from the top point 1 exposing the core material, as shown in FIGS. 5 and 6. In this case, the sheet piece is stripped off along the stretched direction (direction of tearing off). Because the "stretched direction" is spirally wound relative to the core material, the sheet piece is likewise stripped off in a spiral form and the core material is thereby exposed by a length corresponding to the width of the stripped-off piece. It is possible to strip off the sheet piece from a wrapped sheet easily as with a cellophane tape, because the adhesion is between one face of the resin sheet and another. It is also possible to make a break in the end 4 so that the sheet piece can be stripped off by the preferred width.

The pencils of the present invention have a simple structure and can be easily manufactured. In addition, their holders are made up with the stretched resin sheet which is easily torn off, so the exposure of core material *c* is done at a users'discretion, utilizing the capability of the sheet being torn off without requiring perforating. As the material of the resin used in the present invention, the material containing an inorganic filler produces especially excellent results. That is, by using this sheet as the material for a holder, advantageous results such as the appropriate hygroscopic, good touch and excellency in coloring, dyeing, printing and emboss processing, etc. can be realized, and it is possible to sharpen the pencil also with a knife because the sheet material has similar characteristics to that of wood. Furthermore, other advantages can be obtained. For example, the sheet material can be easily wrapped since the sheet layers do not readily or easily slip relative to each other. Further, the weight of the holder can be altered by varying the amount of filler, etc. contained therein.

The pencils of the present invention can be applied to crayon, stick-shaped shoeshine, lipstick, pencil-shaped eraser, etc. as well as to various kinds of pencils for writing.

The stretched resin sheet used in the present invention is stretched generally in the direction of the arrows illustrated in FIGS. 1 and 2. By stretching the sheets in such directions, as is well known in the art, resin molecules are oriented in directions indicated by the dashed lines in FIG. 2. Depending upon the thickness of the material, the type of material used and the degree of stretching, the spacing between lines of aligned molecules (that is, spacing between dashed lines in FIGS. 1 and 2) may be varied. The lines of aligned molecules create lines of weakness which enable the sheet material to be easily stripped off in, for example, narrow strips, from the pencil so as to selectively expose a length of the core material *c*.

We claim:

1. Pencil not requiring sharpening, comprising:

a core material; and an unperforated uniaxially stretched thermoplastic resin sheet, having a plurality of spaced lines of molecules oriented generally in the stretched direction, wrapped around said core material so that a stretched direction of the sheet, and said lines of molecules, form a spiral along the length of said core material and that the sheet forms a smooth outer-surfaced holder, the sheet being selectively tearable off of said core in strips substantially along said lines of molecules to selectively expose said core material.

2. Pencil according to claim 1, wherein said core material is a material selected from the group consisting of a mixture of graphite and clay, crayon, stick-shaped shoeshine, lipstick and eraser.

3. Pencil according to claim 1, wherein said thermoplastic resin is a resin selected from the group consisting of a high pressure polyethylene, an intermediate pressure polyethylene, a low pressure polyethylene, a polypropylene, a polystyrene, a polyvinyl chloride, and mixtures thereof.

4. Pencil according to claim 1, wherein said thermoplastic resin contains an inorganic filler.

5. Pencil according to claim 4, wherein said filler is a filler selected from the group consisting of zinc oxide, titanium oxide, magnesium carbonate, barium sulfate, calcium sulfate, calcium carbonate, calcium sulfite, silicic acid, kaoline, talc, alumina, alumina hydrate, and mixtures thereof.

6. Pencil according to claim 1, wherein said core material is a mixture of graphite and clay, and said thermoplastic resin sheet is polyolefin resin sheet.

7. Pencil according to claim 1 wherein said core material is an elongated, generally rod-shaped, material.

8. A method of making a pencil which does not require sharpening, comprising:

uniaxially stretching an unperforated thermoplastic resin sheet to produce spaced lines of resin molecules oriented generally in the stretching direction; then orienting an elongated core material relative to said uniaxially stretched unperforated thermoplastic resin sheet at an angle of less than 90° to the direction of stretching of said sheet; and wrapping said stretched unperforated sheet around said core material such that the stretched direction of the sheet, and said lines of molecules form a spiral along the length of said core material, said wrapped sheet forming a smooth outer-surfaced holder for the pencil and being selectively tearable off of said core in strips substantially along said lines of molecules to selectively expose said core material.

* * * * *